United States Patent [19]

MacLellan

[11] Patent Number: 4,716,437

[45] Date of Patent: Dec. 29, 1987

[54] DEVELOPMENT STATION HAVING APERTURED THIN FILM FOR CONTROLLING THE FLOW OF DEVELOPER MATERIAL

[75] Inventor: Bruce D. MacLellan, Ontario, N.Y.

[73] Assignee: Eastman Kodak Company, Rochester, N.Y.

[21] Appl. No.: 932,415

[22] Filed: Nov. 19, 1986

[51] Int. Cl.[4] ..... G03G 15/00; G03G 15/09

[52] U.S. Cl. ..... 355/3 DD; 118/656; 222/DIG. 1; 355/3 R; 355/14 D

[58] Field of Search ..... 355/3 DD, 3 DR, 4, 14 D; 222/DIG. 1, 565; 118/656, 657, 658, 623

[56] References Cited

U.S. PATENT DOCUMENTS

| | | | |
|---|---|---|---|
| 3,863,603 | 2/1975 | Buckley et al. | 355/3 DD |
| 3,995,589 | 12/1976 | Salger . | |
| 4,334,760 | 6/1982 | Rodger | 355/3 DD |
| 4,373,798 | 2/1983 | Isukado | 355/3 DD |
| 4,435,065 | 3/1984 | Wada | 355/3 DD |
| 4,438,722 | 3/1984 | Foriani | 355/3 DD |
| 4,460,266 | 7/1984 | Kopp | 355/3 DD |
| 4,469,427 | 9/1984 | Kopp | 355/3 DD |
| 4,523,833 | 6/1985 | Jones | 355/3 DD |
| 4,553,829 | 11/1985 | Bores | 355/3 DD |
| 4,583,841 | 4/1986 | Crandall | 355/3 DD |
| 4,625,895 | 12/1986 | Tsukano | 355/3 DD |
| 4,671,207 | 6/1987 | Hilbert | 118/657 |

FOREIGN PATENT DOCUMENTS

| | | | |
|---|---|---|---|
| 0160830 | 11/1985 | European Pat. Off. | 355/3 DD |
| 115969 | 6/1985 | Japan | 355/14 D |
| 151666 | 8/1985 | Japan | 355/3 DD |
| 235173 | 11/1985 | Japan | 355/3 DD |
| 239770 | 11/1985 | Japan | 355/4 |

OTHER PUBLICATIONS

IBM Technical Disclosure Bulletin, vol. 26, No. 7B Dec. 1983.

*Primary Examiner*—Arthur T. Grimley
*Assistant Examiner*—Ed Pipala
*Attorney, Agent, or Firm*—G. Herman Childress

[57] ABSTRACT

A development station conveys developer material from a sump to a magnetic brush for development of latent images on a photoconductor. The developer material flows through a slot adjacent the magnetic brush. A thin film having a plurality of apertures is positioned adjacent the slot. The film is movable to align the apertures with the slot so that developer material can pass through the slot to the brush. Movement of the film perforations out of alignment with the slot shuts off the flow of developer material to the magnetic brush.

5 Claims, 4 Drawing Figures

FIG. 2
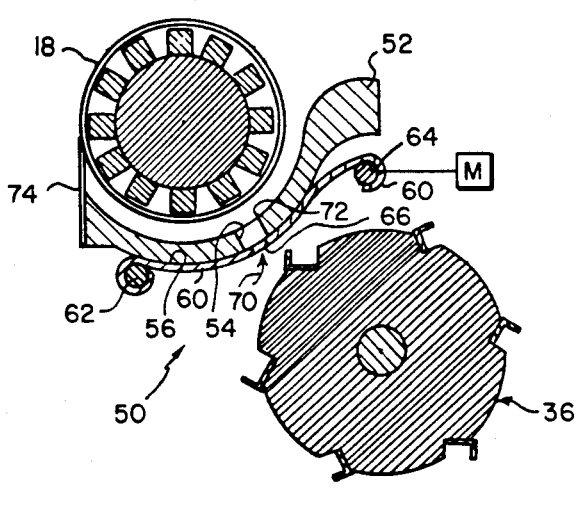
FIG. 3
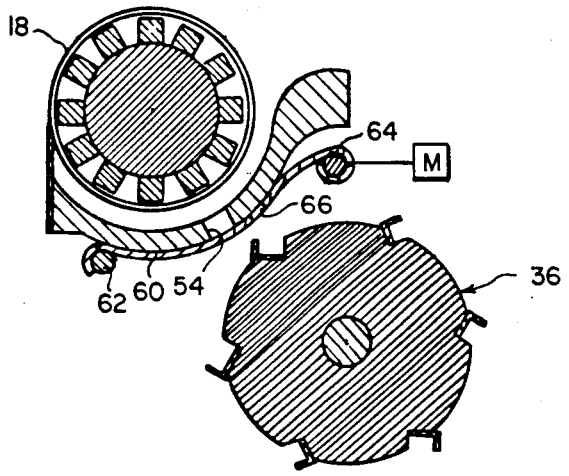
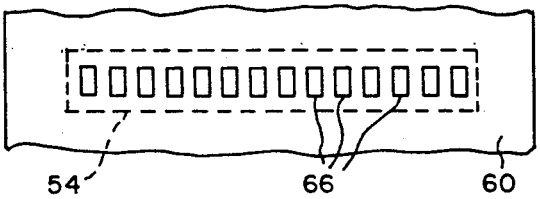
FIG. 4

DEVELOPMENT STATION HAVING APERTURED THIN FILM FOR CONTROLLING THE FLOW OF DEVELOPER MATERIAL

BACKGROUND OF THE INVENTION

U.S. Pat. No. 4,553,829, issued Nov. 19, 1985 in the name of J. Bares, and entitled "Metering Blade for Use in a Development System" discloses a magnetic brush development station wherein developer material from a sump is provided to a magnetic brush for development of latent images on a photoconductor. A metering blade engageable with the brush has a plurality of apertures arranged in rows through which the developer material must pass as it travels from the sump to the magnetic brush for development of latent images. The size of the apertures controls the thickness of the layer of developer material advanced to the latent image. A similar disclosure appears in U.S. Pat. No. 4,523,833, issued June 18, 1985 in the name of T. B. Jones, and entitled "Developer Roller Metering Blade." In the Jones patent electrodes are connected to a voltage source and to the blade to regulate the quantity of developer material that passes through the apertures in the blade, thereby controlling the thickness of the layer of developer material on the magnetic brush. Column 6, lines 64–68 of the Jones patent suggests that adjustment of the intensity of the electrical field to a suitable level will prevent developer material from passing through the apertures so that an on/off type of control can be achieved.

Apparatus of the type disclosed in the patents identified above require a metering blade to be held tightly in engagement with the outer surface of the magnetic brush. If the shell of the brush rotates, substantial wear can occur. Even if the shell is stationary there is a critical adjustment of the blade against the shell in order to maintain the required control of developer material. If the material leaks under the blade contamination can result and complete shutoff of material will not be achieved. Moreover, the apparatus shown in both of such patents allows developer material to be in contact with the magnetic brush at all times, thus increasing the torque required to drive the magnetic brush even when no flow of developer material is desired.

SUMMARY OF THE INVENTION

Accordingly, it is an object of the present invention to provide accurate metering and, when desired, complete shutoff of developer material to a magnetic brush without using a blade resting against the magnetic brush, thereby avoiding the need for critical adjustment of the blade, reducing the torque applied to the magnetic brush and decreasing contamination caused by material leaking past the blade. Other objects of the invention are to provide an improved developer metering and shutoff apparatus which is self sealing, which increases developer life and decreases torque requirements by being able to shut off developer flow to the magnetic brush, and which improves the life of the wiper blade typically provided for scraping developer material from the magnetic brush after such material passes through a development zone.

The present invention relates to electrographic apparatus having a development station with a magnetic brush for applying developer material to a photoconductor. Means are provided for feeding developer material to the magnetic brush, and an opening is defined between the magnetic brush and the feeding means through which developer material passes as it is conveyed to the brush. The improvement of the invention comprises means for controlling flow of developer material from the feeding means to the magnetic brush through the opening. The controlling means comprises a member having a plurality of apertures through which developer material can flow. The controlling means also comprises means for moving the apertured member between a first position wherein the apertures are aligned with the opening so that developer material from the feeding means can pass through the apertures and be delivered to the magnetic brush and a second position wherein the apertures are displaced from the opening to block the flow of developer material from the feeding means to the opening.

BRIEF DESCRIPTION OF THE DRAWINGS

In the detailed description of the preferred embodiment of the invention presented below, reference is made to the drawings, in which:

FIG. 2 is an enlarged fragmentary view of the apparatus for controlling flow of developer material to the magnetic brush in its open position;

FIG. 3 is a view similar to FIG. 2 showing the control apparatus in its closed position; and FIG. 4 is a fragmentary plan view of part of the control apparatus.

DETAILED DESCRIPTION OF THE INVENTION

Figure 1:
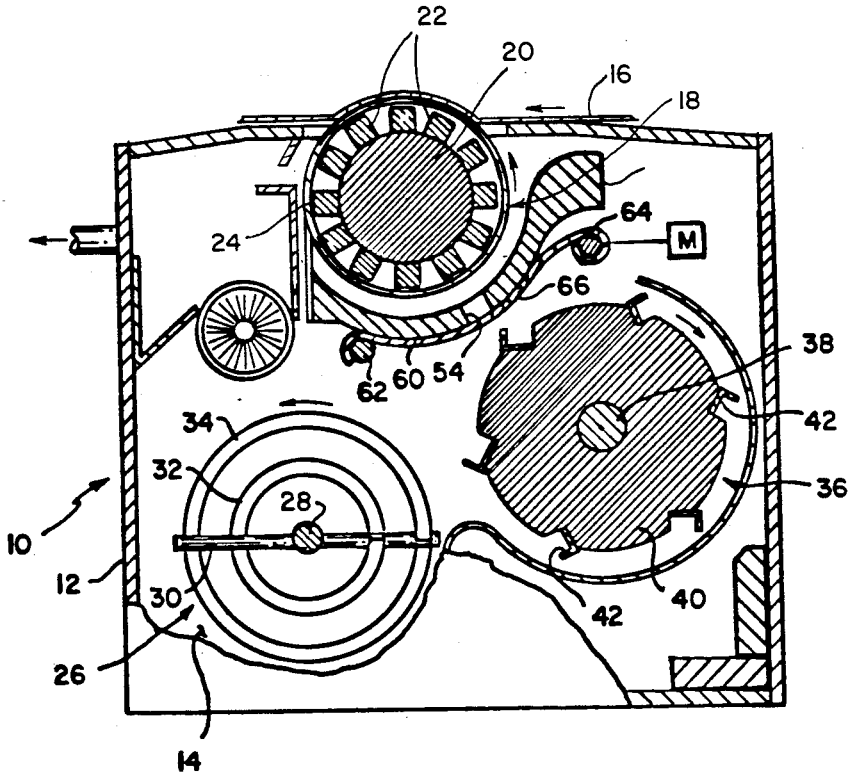
FIG. 1 is an end view of a development station of electrographic apparatus incorporating the present invention.

Referring now to FIG. 1 of the drawings, a development station of an electrographic apparatus is generally designated 10 and comprises a housing 12 that defines a sump 14 for receiving developer material. A photoconductor 16 travels across the upper portion of the housing 12 and contains on its lower surface one or more latent electrostatic images that are developed by developer material from sump 14. The developed images can be transferred to a copy sheet and fused thereto in a known manner or fused onto the photoconductor itself.

The development station 10 has a magnetic brush 18 for applying developer material to the images on photoconductor 16. The brush illustrated comprises a core 20 having a plurality of magnets 22 spaced around the core, and a cylindrical, non magnetic shell 24 that surrounds the core 20. The core and/or shell can be fixed or rotatable, as known in the art. As illustrated in the drawings, the core 20 is rotatable in a clockwise direction, and the shell rotates in a counterclockwise direction to thereby feed developer material in a counterclockwise direction to the photoconductor.

Developer material in sump 14 can be mixed, agitated and triboelectrically sheared by means of a ribbon blender generally designated 26. Blender 26 comprises a shaft 28 that is rotatable about its axis and has a plurality of rods 30 projecting therefrom. The rods carry inner and outer helical ribbons 32, 34. The pitch of the ribbon 32 is opposite from ribbon 34 so that when the shaft 28 is driven in a counterclockwise direction as shown in FIG. 1, ribbon 32 tends to drive developer material in one direction through the sump 14 while ribbon 34 tends to drive the material in the opposite direction.

Material from sump 14 is moved by the ribbon blender not only axially in the sump but also radially outwardly so that some of the material is provided to a feeding means generally shown at 36. Feeding means 36 includes a shaft 38 that is rotated in a clockwise direction and carries two or more plates 40. The plates support a plurality of vanes 42 that pick up developer material from the ribbon blender 26 and bring such material into close proximity with the shell 24 of the magnetic brush 18. At that point the magnets 22 of the core 20 attract the developer material to the shell so that it can be delivered to the photoconductor 16 by the magnetic brush.

The electrographic apparatus described hereinbefore is disclosed in more detail in European Patent Office Publication No. 160,830, published Nov. 13, 1985, which is based on U.S. patent application Ser. No. 597,323, filed Apr. 6, 1984. Reference is made to that publication for a more complete description of the apparatus.

Control means generally designated 50 is provided for regulating the flow of developer material from the feeding means 36 to the magnetic brush 18. As best shown in FIGS. 2 and 3, the control means 50 comprises an elongate block 52 that is beneath the lower right portion of the magnetic brush. Thus block 52 is located between the magnetic brush and the sump and also between the magnetic brush and the feeding means 36. Block 52 can be connected to or supported from the housing 14 in a suitable manner. In the central portion of the block 52 there is an elongate, generally rectangular feed slot 54 that is substantially aligned with the portions of the feed means 36 and magnetic brush 18 that are closest to each other. Preferably the slot 54 extends substantially the full length of the magnetic brush 18 and is closely adjacent the feeding means 36. Slot 54 comprises a metering slot through which material can pass from the feeding means 36 to the magnetic brush as explained in more detail later. A curved, generally cylindrical surface 56 is provided on block 52 on both sides of the slot 54. The particular curvature shown in the drawings has its center at or near the axis of rotation of the magnetic brush 18. This location of the center of curvature can be varied, of course.

Movement of developer material through metering slot 54 is controlled by a thin, compliant film 60 that is stretched across the surface 56 and slot 54. Film 60 is attached at its ends to reels or shafts 62, 64, each of which are rotatable in two opposite directions so that the film can be wound onto or unwound from each of the shafts. Shafts 62, 64 are located with respect to surface 56 so that an intermediate portion of the film extends along and is urged against surface 56. As best shown in FIG. 4, a plurality of spaced and aligned apertures 66 are provided in this intermediate portion of the film. The apertures preferably are spaced from each other along the width of the film 60 and aligned in a row. Preferably the perforations are provided throughout substantially the entire length of the slot 54.

One of the shafts, such as shaft 64, is connected to a motor M so that the shaft can be driven to move the film 60 along surface 56 from its FIG. 2 to its FIG. 3 position and thereby move the apertures 66 from a position aligned with the slot 54, as shown in FIG. 2, to a position wherein the apertures are offset from slot 54, as shown in FIG. 3. Return movement of the film can be effected by another motor connected to shaft 62, or by a spring which urges shaft 62 in a counterclockwise direction.

In operation, when developer material is to be provided to magnetic brush 18 for developing latent images on the photoconductor, film 60 is moved to its position shown in FIG. 2. Operation of the ribbon blender 26 and the feeding means 36 brings a supply of developer material into the area between the feeding means and the adjacent portion of the magnetic brush 18. At this time the magnets 22 of the magnetic brush attract the developer material toward the magnetic brush, thereby causing some of the material to flow along the path shown by arrow 70 in FIG. 2 through the apertures 66 and the metering slot 54. The material thus attracted to the magnetic brush is advanced by the brush to the developing zone between the brush and the photoconductor. The thickness of the layer of material deposited on the magnetic brush is governed by the size and number of apertures 66 and an edge 72 of the block 52, which acts as a metering skive. After the developer material on the magnetic brush passes the development zone, it is scraped from the outer surface of the magnetic brush by a wiper 74 secured to the left edge of block 52 and engageable with the outer surface of the magnetic brush.

When it is desired to shut off the flow of developer material to the magnetic brush, motor M is energized to rotate shaft 64 in a clockwise direction and thereby move the aperture 66 of film 60 from the position aligned with slot 54, as shown in FIGS. 2 and 4, to the position shown in FIG. 3 wherein the apertures are offset from the slot 54, thereby shutting off the flow of developer material through the slot to the magnetic brush. At this time a tight seal is formed across the width of the slot 54 by the film 60. More specifically, the magnets 22 of the magnetic brush continue to attract developer material from feeding means 36 toward the magnetic brush. This material is urged against the thin compliant film 60, causing it to be forced tightly against the periphery of the slot 54. In addition, the film is held tightly against surface 56 due to the location of shafts 62, 64 relative to that surface. This seal not only assures complete shutoff of the flow of developer material through the slot, but also helps assure undesirable leaking of developer material from inside the housing 12 to the exterior of the housing through the slot or from around the magnetic brush. Thus contamination is decreased, copy quality is increased and service calls are decreased.

A number of advantages result from the apparatus for shutting off flow of developer material to the magnetic brush. First of all, less torque is required to drive the magnetic brush when the flow of developer material to the brush has been shut off. This not only reduces torque requirements but also reduces power requirements and heat generated by operation of the development station. Moreover, the life of the developer material is increased by limiting its exposure to the magnetic brush. Another advantage is that the metering skive provided by edge 72 need not be critical, as with some prior devices, since the number and size of the apertures 66 largely provide the critical metering of the developer material to the magnetic brush. In addition, the life of wiper 74 is prolonged because it is not required to constantly remove developer material from the magnetic brush.

Another advantage of the invention is that very little movement of the film is required to start or stop the flow of developer material to the magnetic brush. This is important, especially in color copiers where a series of development stations are provided and they need to be cycled on and off at precisely the right time in the machine cycle for development of the latent images on the photoconductor.

Another advantage of the apparatus of the invention is that the size of the metering apertures can be readily changed, as desired, in order to provide different operating conditions. In this regard, it will be understood that more than one row of metering apertures can be provided in the film 60 and spaced from each other so that one or the other row of perforations can be aligned with the slot 54 by rotating the shafts 62, 64. This simple adjustment could be provided by the machine operator or by the logic and control apparatus of the machine without the need for a skilled service person.

While the invention has been described in connection with a preferred embodiment thereof, it will be understood that variations and modifications can be effected within the spirit and scope of the invention as described hereinabove and as defined in the appended claims.

I claim:

1. In electrographic apparatus having a development station with a magnetic brush for applying developer material to a photoconductor, means for feeding developer material to the magnetic brush, and means defining an opening between the magnetic brush and the feeding means through which developer material passes as it is fed to the brush, the improvement comprising:

means for controlling the flow of developer material from the feeding means to the magnetic brush through the opening, the controlling means comprising a thin, flexible member positioned between the feeding means and the opening, the member having a plurality of apertures through which developer material can flow, and means for moving member between (1) a first position wherein the apertures are aligned with the opening so that developer material from the feeding means can pass through the apertures and be delivered to the magnetic brush and (2) a second position wherein the apertures are displaced from the opening to block the flow of developer material from the feeding means through the opening.

2. The invention as set forth in claim 1 wherein the opening defining means has a curved surface adjacent the opening and facing the feeding means, and the member is mounted so that an intermediate portion thereof extends along and is urged against the curved surface so that when the member is in its second position developer material from the feeding means is urged against the member to force the member to flex against the surface and thus seal the opening and prevent flow of developer material through the opening.

3. In electrographic apparatus having a development station with a magnetic brush for applying developer material to a photoconductor, the magnetic brush having a plurality of magnets for attracting developer material toward the brush, means for feeding developer material to the magnetic brush, and means defining an elongate slot between the magnetic brush and the feeding means through which developer material passes as it is fed to the magnetic brush, the improvement comprising:

a thin, flexible film adjacent the slot, the film having a plurality of apertures arranged in a row through which developer material can flow.

means connected to the film for moving the film relative to the slot between (1) a first position wherein the apertures are aligned with the slot so that developer material from the feeding means can pass through the apertures and be delivered to the magnetic brush and (2) a second position wherein the apertures are displaced from the slot and a portion of the film blocks the flow of developer material from the feeding means through the slot.

4. The invention as set forth in claim 3 wherein the means defining the slot comprises a block having a curved surface, the slot extending through the curved surface, and the film bears against the curved surface, the curved surface being on a side of the block opposite from the magnetic brush so that when the film is in its second position the magnets in the brush urge developer material from the feeding means against the portion of the film that blocks that flow of developer material through the opening, thereby positively sealing the slot.

5. In electrographic apparatus having a development station with a magnetic brush for applying developer material to a photoconductor, means for feeding developer material to the magnetic brush, and means defining an opening between the magnetic brush and the feeding means through which developer material passes as it is fed to the brush, the improvement comprising:

means for controlling the flow of developer material from the feeding means to the magnetic brush through the opening, the controlling means comprising a thin film member having a plurality of apertures through which developer material can flow, and means for moving the member between (1) a first position wherein the apertures are aligned with the opening so that developer material from the feeding means can pass through the apertures and be delivered to the magnetic brush and (2) a second position wherein the apertures are displaced from the opening to block the flow of developer material from the feeding means through the opening, the means for moving the member comprising a shaft connected to the member, the shaft being rotatable to move the member between its first and second positions.

* * * * *